US010398245B2

(12) United States Patent
Prest

(10) Patent No.: US 10,398,245 B2
(45) Date of Patent: Sep. 3, 2019

(54) UNIVERSAL WRAPAROUND STEP COVER

(71) Applicant: PREST-O-FIT MANUFACTURING, INC., Chandler, AZ (US)

(72) Inventor: J. David Prest, Tempe, AZ (US)

(73) Assignee: PREST-O-FIT MANUFACTURING, INC., Tempe, AZ (US)

( * ) Notice: Subject to any disclaimer, the term of this patent is extended or adjusted under 35 U.S.C. 154(b) by 0 days.

(21) Appl. No.: 16/135,390

(22) Filed: Sep. 19, 2018

(65) Prior Publication Data

US 2019/0085565 A1 Mar. 21, 2019

Related U.S. Application Data

(60) Provisional application No. 62/560,468, filed on Sep. 19, 2017.

(51) Int. Cl.

| | |
|---|---|
| ***E04F 11/02*** | (2006.01) |
| ***E04F 11/17*** | (2006.01) |
| ***E04G 21/30*** | (2006.01) |
| ***A47G 27/04*** | (2006.01) |
| ***A47C 31/06*** | (2006.01) |
| *A44B 17/00* | (2006.01) |

(52) U.S. Cl.

CPC ..... *A47G 27/0418* (2013.01); *A47C 31/06* (2013.01); *E04F 11/175* (2013.01); *A44B 17/0041* (2013.01); *E04F 2011/0203* (2013.01); *E04G 21/30* (2013.01)

(58) Field of Classification Search

CPC . E04F 11/175; E04F 11/17; E04F 2011/0203; A47G 27/0287; A47G 27/02; A47C 31/06; B60R 3/04; B60R 3/007; B60R 3/00; E04G 21/30

See application file for complete search history.

(56) References Cited

U.S. PATENT DOCUMENTS

| | | | | |
|---|---|---|---|---|
| 330,963 | A * | 11/1885 | Dennis | E04F 11/17 52/179 |
| 3,093,216 | A * | 6/1963 | Dunham | E04C 2/08 105/375 |
| 6,029,409 | A * | 2/2000 | Wilson | E04G 21/30 150/154 |
| 6,088,976 | A * | 7/2000 | Roy | A47G 27/0287 52/177 |
| 6,216,396 | B1 * | 4/2001 | Katz | A47B 35/00 52/2.11 |
| 7,513,519 | B2 * | 4/2009 | Sharpe | A47L 23/26 280/163 |
| 2008/0229685 | A1 * | 9/2008 | Uncles | E04F 11/104 52/182 |

* cited by examiner

*Primary Examiner* — Christine T Cajilig
(74) *Attorney, Agent, or Firm* — Bycer Law, PLC; Matthew L. Bycer

(57) ABSTRACT

A universal wraparound cover for a step includes opposed ends with equivalent number of multiple tabs and fasteners engaging the tabs through holes in the opposed ends to secure the cover to the step. Rear tabs include multiple reinforced attachment points, and the forward tabs include a single attachment point each. The wraparound cover can therefore be fitted over numerous side supported step types.

12 Claims, 8 Drawing Sheets

UNIVERSAL WRAPAROUND STEP COVER

CROSS REFERENCE TO RELATED APPLICATION

The present application includes subject matter disclosed in and claims priority to prior filed U.S. Provisional Patent Application Ser. No. 62/560,468, filed Sep. 19, 2017, entitled "ADVANCED RUG SYSTEMS", incorporated herein by reference and describing an invention made by the present inventor.

BACKGROUND OF THE INVENTION

1. Field of the Invention

The present invention relates to step covers and, more particularly, to a wraparound step cover.

2. Description of Related Prior Art

Numerous types of step covers have been used over the years. The most common step cover is simply material, usually a rubber composition, which is attached to the top of a step by a mastic, brads, or the like. Such a cover may extend partially or fully along the top surface of the step. Some step covers wrap partially around a step such that the opposed edges of the cover extend onto the sides or bottom of the step and are attached by nails, brads, or a mastic. A potentially removable step cover extends partially about each longitudinal edge of a step and partially on to the bottom of the step. The opposing ends of the cover at the bottom of the step are latched with one another by cords or the like penetrably engaging apertures along the edges of the cover under the step.

The first two types of covers discussed above are usually permanently or at least semi-permanently attached to a step. This creates difficulties when the covers are to be replaced due to wear, damage or discoloration. The third type of cover is relatively easily removed but while in operation the forces exerted by the cords tend to cause a cover to pucker due to the non-uniform pulling forces exerted by the engaged cords. This puckering renders these types of covers relatively unsightly. If the pucker extends to the top of the step, a safety hazard exists as it may cause a user to trip.

In the recreational vehicle (RV) and camping market, as well as standard industrial and warehouses, there are numerous types, shapes, sizes, etc. of steps for various purposes. Particularly, in the RV industry there are four or five major step types that typically fold up into the side of the RV, or otherwise are collapsible, or placeable when parked. While there exist specific covers for each type of step, there has yet to be found a universal step cover that can adequately cover all major step types for the RV that does not pucker, or otherwise become inadequate.

SUMMARY OF THE INVENTION

The present invention is directed to a cover or rug for a step that extends across the top of the step with the longitudinal ends thereof extending along the front and back sides and partially onto the bottom of the step, or to completely cover the step. The rear end of the cover includes a multitude of fingered tabs, each fingered tab containing a multitude of attachment points for attaching a fastener. The fingered tabs provide for a distributed tension force along the width of the step to avoid puckering. The forward end of the cover includes a similar number of fingered tabs, each fingered tab containing a single attachment point for attaching to a fastener with the related rear tab. Furthermore, the front end includes an underside surface with a mounted fastening area (strip) that meets with a complimentary fastening area applied to the front of the step to be covered. Fastening strips and fastening areas are preferably hook-and-loop complimentary fastener type as is known in the art, preferably with the 'loop' along the underside of the rug, and the 'hook' along the step. It is preferable that the fingered tabs and forward tabs number four, and that the multitude of fasteners in the rear tabs includes at least three, and preferably four, fastening points. The fastening points are preferably reinforced grommetted holes, and the fastener is preferably a dual-hooked spring. The front and rear edges of the cover are drawn toward one another to secure the cover in place by fasteners engaging pairs of holes in the opposing ends of the cover. By tightening the fasteners, sufficient friction exists between the cover and the step to prevent sliding movement of the cover along the step. Replacement of a cover is a simple matter of removing the tensioning springs to disengage the old cover releasing fastening strips, and remove it. The replacement cover is secured in place with new fasteners, and/or the original cover can be used on an alternate step.

It is therefore a primary object of the present invention to provide a detachably attached cover that extends along the top, sides and onto the bottom of a step.

Another object of the present invention is to provide a cover that wraps along the top and sides of a step and applying a distributed force exerted along opposing ends of the cover to draw them toward one another on the bottom of the step and retain the cover in place.

A yet further object of the present invention is to provide a wraparound cover having front and back split ends extending beneath a step to accommodate varied step sizes.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

The principle nature of the present invention is to include a universal step cover that can cover a myriad of step sizes and shapes as are known in the art. Particularly, steps are supported on either ends and are free in the front and rear (above and below) for use. In some RV embodiments, steps are supported by side brackets that are hingedly coupled with a bar to the vehicle (not shown). A universal cover 10 may be used and applied over the step without interfering with the side mounts or supports. The step includes a front, back, top, bottom. A fastening patch will be applied to the front of the step for mating with the universal step cover. U.S. Pat. No. 9,945,137 entitled "Wraparound Cover for a Step" issued Apr. 17, 2018 to the same inventor is hereby incorporated by reference.

Figure 1:
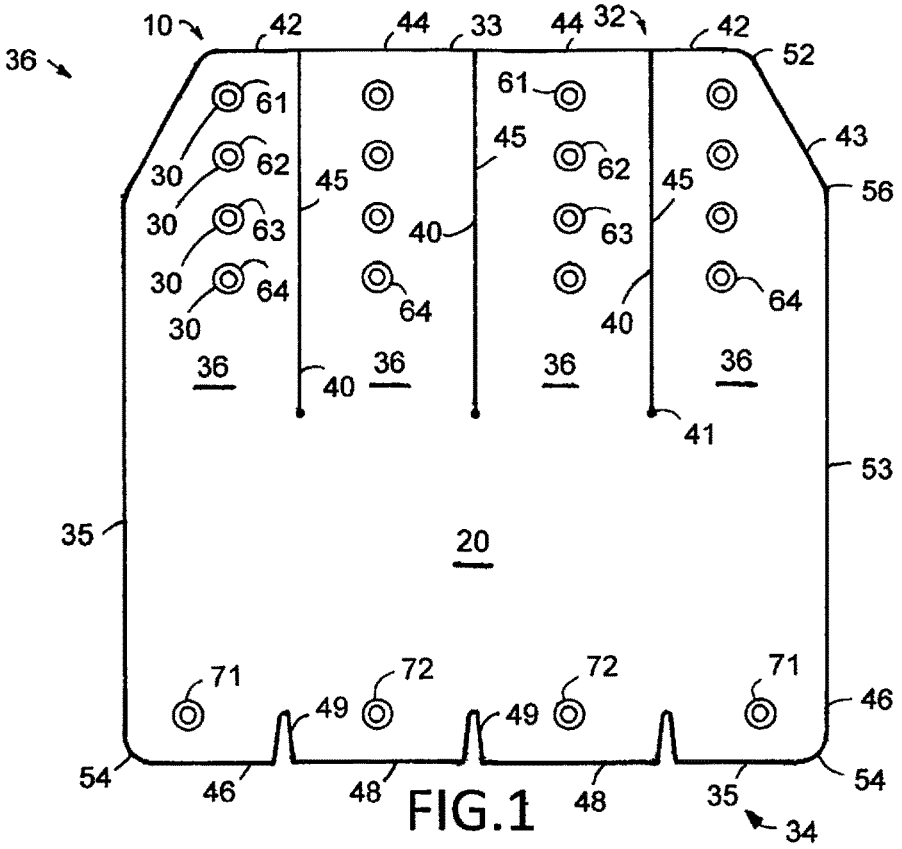
FIG. 1 illustrates a top view of an embodiment of a wraparound cover of the present invention.

Referring to FIG. 1, the top of the universal step cover of an embodiment of the invention is shown. Universal step cover 10 includes outer edge 53 circumscribing the entirety of the universal step cover. The universal step cover is preferably a flat rug as is known in the art and may include surface features such as ridges, spikes, loops, carpet, or otherwise as is known for step covers in the art. The rear 32 of the step cover 10 includes a multitude of fingered tabs 36. Outer end tabs 42 provide a multitude of attachment points, or grommets 30, for accepting a fastener. In this embodiment, four fingered tabs 36 each comprise four grommets 30. Outer end tab 42 includes top corner with rounded edge 52. It is preferred that rounded edge 52 comprises an arc length of a circle with a 1-inch radius. Rounded edge 52 leads to angled end 43 and around edge 53 to outer corner 56. Rear end 32 includes outer end tabs 42 and inner end tabs 44 separated via slits 40. It is preferable that the slits define interior edges 45 between each of the rear fingered tab 42 and 44. While it is preferable that a minimum or zero space exist along the interior edges in slit 40, some space may be needed. Each of the rear fingered tabs should be moveable relative one another and flexible to allow for wrapping around a step. Slits 40 emanate from root 41. Root 41 is preferably a mostly circular aperture stamped into the material for the cover to allow for ease of use with the flexible cover and folding individual flexible tabs. Roots are preferably approximately 3/16ths of an inch in diameter.

Preferably, each of the rear fingered tabs 36 are approximately 5½ inches in width. The grommets will preferably be positioned in a specific location to allow for the cover to mate with a variety of steps. As can be seen, grommets 30 are placed in fingered tabs, preferably four unequally spaced grommets. Each grommet, preferably, includes a center aperture of approximately ⅜ths inch and the aperture is preferably mostly circular. An outer diameter for the grommet is preferably approximately ⅞ths of an inch. The measurement between the grommets is discussed below with reference to the center of the aperture within each grommet hole. The furthermost rear grommet 61 is preferably approximately 1½ inch from rear edge 33. Middle rear far grommet 62 is preferably positioned approximately 1⅞ths inch from rear grommet 61. Middle rear close grommet 63 is preferably spaced approximately 2 inches from middle rear far grommet 62. Rear interior grommet 64 is preferably positioned approximately 1⅞ths inch from middle rear close grommet 63. These fingered tab rear grommets are preferably spaced in parallel with one another along a fixed line from rear edge 33 to forward edge 35. Outer rear tab 42 preferably includes grommets spaced approximately 3¼ inches from the furthermost side edge of material 53. Outer rear tab 42 includes grommets spaced from inner rear tab 44 at approximately a 4¾ inch spacing. The interior grommets of inner end 44 are spaced further apart at approximately six inches.

It is preferred that the slits are approximately 15½ inches from rear edge 33 to root 41. Each of the outer rear tabs 42 and inner rear tabs 44 are each preferably sized identically at approximately 5½ inches in width. Moving from angled end 52 to corner 56, a five inch ray is defined by angled end 43. It is preferred that rounded edge 52 comprises approximately a 120 degree angle, while corner comprises approximately a 150 degree angle.

Moving to front 34 of universal step cover 10, a similar number of tabs are shown. Here, four tabs are shown each with a single grommet associated with it. Outer forward tabs 46 comprise the edges of the forward end of the material, while inner tabs 48 comprise the interior tabs. Front corners 54 are preferably sized similarly with a one inch radius turn at approximately 90 degree turn. The grommet spacing in the forward end is much different than that in the back end. Preferably, outer grommets 71 are preferably spaced approximately two inches from side end 35. Spacing between the outer grommet 71 and nearest inner grommet 72 is approximately six inches, with the spacing across the forward end grommet is approximately six inches between each grommet with the outer grommets being approximately two inches from the side 35. Forward grommets 71 and 72, are preferably spaced approximately 1½ inches from front end 34 with the same amount of spaces as the length of gaps 49 between each of the forward tabs 46 and 48. Forward tabs are preferably angled and include a gap 49 with an initial width of 3/16ths inch widening to a ½ inch with a rounded top and open end in front. Spacing between the front end 34 and root 41 is approximately 11 inches while the length from front end 34 to the interior of the rear interior grommet 64 is approximately 15¼ inches. The entire cover is preferably approximately 22½ inches from top end to bottom end and 22 inches wide. The back end surface between the rounded edges 52 is approximately 17 inches. Side-by-side, spacing between rear end grommets is approximately 3¼ inches from outer end 42 grommets to side 35, 4¾ inches between outer end and inner end rear grommets, with six inches between inner end grommets.

Front end tabs are preferably of varied sizes, with outer tab 46 being approximately 4¾ inches along end and inner tabs forward 48 being approximately 5½ inches. Thereby, the width between the top of each gap of the forward tabs is approximately five inches while those of the inner forward tabs are six inches. The cover includes approximately 18 inches between outer corner 56 and front corner 54.

Figure 2:
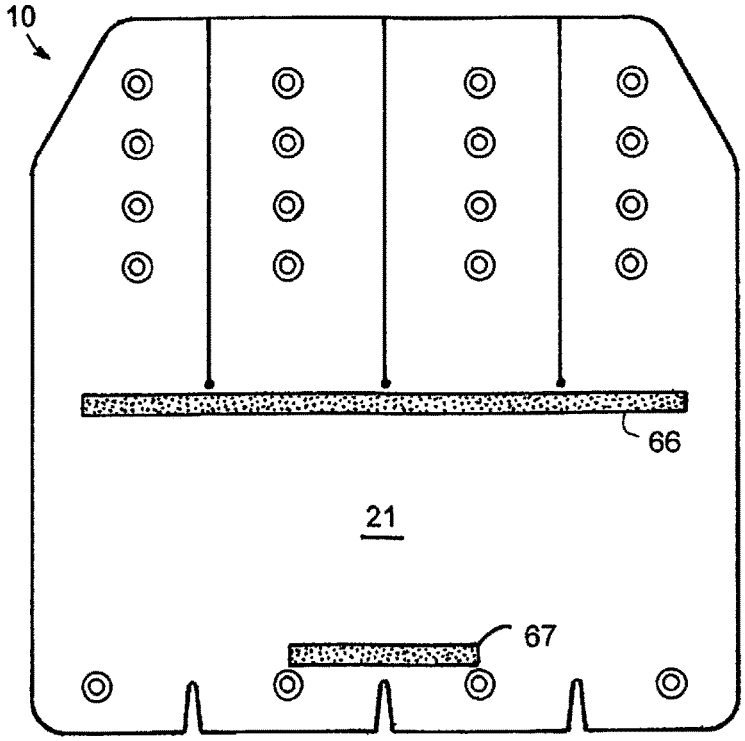
FIG. 2 illustrates a bottom view of an embodiment of a wraparound cover of the present invention.

Referring now to FIG. 2, the bottom surface of the universal step cover 10 is shown. Most particularly, the distance between the fastening strips rear and forward is important to ensure that the step cover fits over a myriad of varied steps as is known in the art. Forward fastening strip 67 is approximately six inches wide and approximately 3¼ inches tall. Rear fastening strip 66 is approximately 19 inches wide and similarly 3¼ inches tall. One essential distance of the present invention is that between the rear and forward fastening strips preferably parallel to one another and perpendicular sides of the rug. Each of the fastening strips must be positioned to ensure proper fit. While forward fastening strip is approximately 6 inches wide, it should be positioned along the center of the step cover as is the 19 inch rear fastening strip. The bottom of the forward fastening strip should be approximately two inches from the edge of the fastening strip to the forward edge 34 of the cover. The top 67A of the forward fastening strip should be approximately eight inches from the top 66A of the rear fastening strip. The distance of eight inches more or less ¼ inch, or more or less ½ inch, is essential. The distance between the nearest edges of the rear and forward fastening strips should therefore be approximately 7¼ inch.

Figure 3:
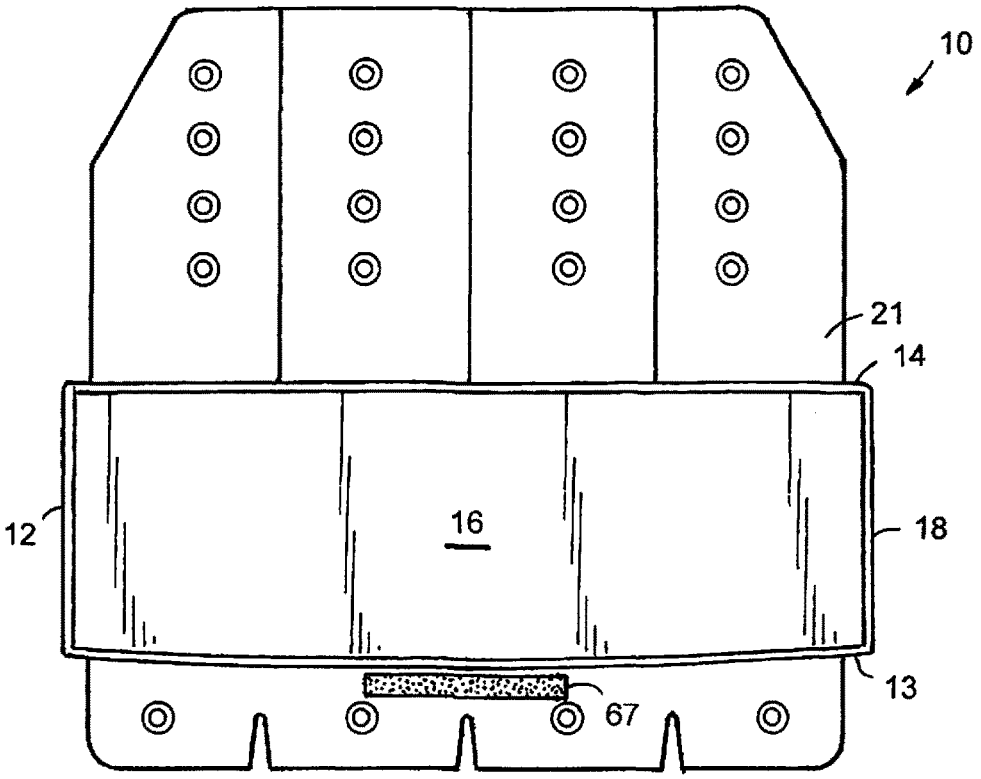
FIG. 3 illustrates a bottom view of an embodiment of a wraparound cover with bottom of step applied thereon.

Referring to FIG. 3, a step is placed onto the underside 21 of step cover 10. As can be seen, step 12 includes exposed bottom 16 and side 18. Step includes front 13 and back 14. Forward fastening strip 67 on cover 10 is shown exposed along step front 13.

Figure 4:
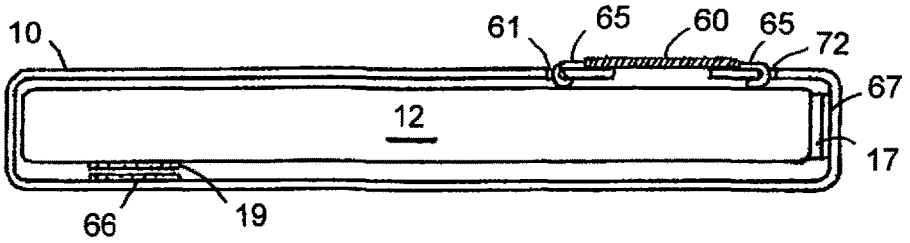
FIG. 4 illustrates a side view of an embodiment of a wraparound cover applied to a step.

Referring now to FIG. 4, a cross-sectional side view of the cover applied to an upside down deep step is shown. Step includes features such as top patch 19 as a fastening strip to mate with rear fastening strip 66 of cover 10. Furthermore, forward fastening strip 67 mates with a forward fastening patch 17 along step 12 front 13. Attachment points, such as grommets 72 and 61 are joined together by fastener 60. In this embodiment, fastener 60 comprises a dual hooked spring, but fastener may be of any type known in the art, including tie wraps, rope, or otherwise as is known in the art. Fastener 60 includes dual hook 65 engaging each of fastening points at grommets 61 and 72.

Figure 5:
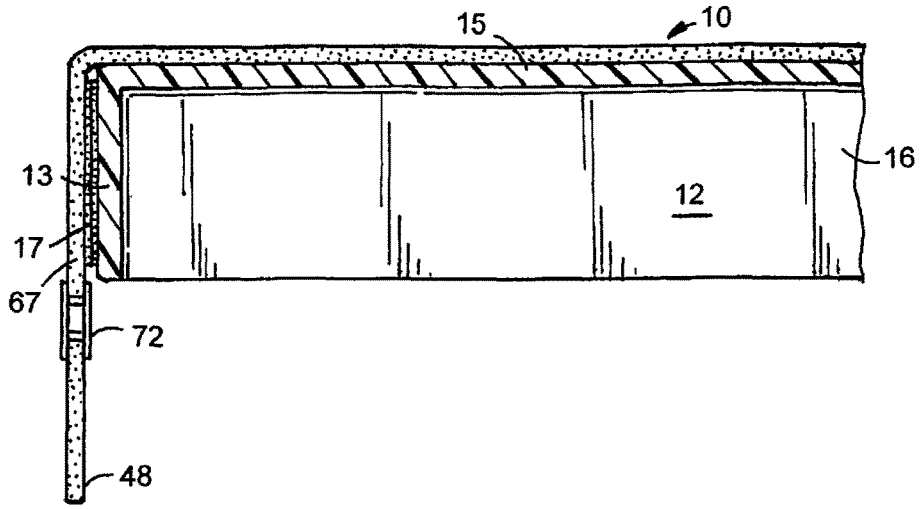
FIG. 5 illustrates a cross-sectional side view of an embodiment of a wraparound cover applied to a short step.
Figure 6:
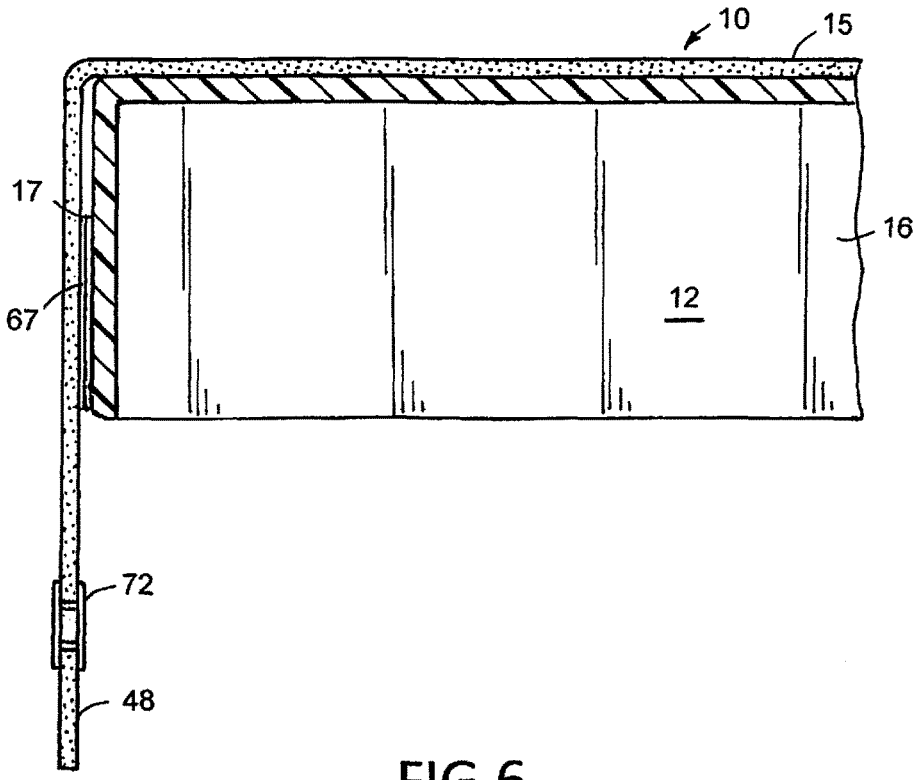
FIG. 6 illustrates a cross-sectional side view of an embodiment of a wraparound cover applied to a tall step.

Referring now to FIG. 5 and FIG. 6, a cross-sectional side view of the front of the step (now right side up) is shown. A short step is shown in FIG. 5, and a tall step is shown in FIG. 6. Step 12 includes bottom side 16, preferably hollowed out to show the bottom exposed along an upper edge, acting as a ceiling. Step includes top 15 which is then covered by wraparound step cover 10. Step front 13 includes front fastening patch 17 to engage with fastening strip forward 67 along cover 10. Inner grommet forward 72 is shown hanging along an inner forward tab 48. It is to be noted, that in FIG. 6, a taller step will include a front fastening patch 17 along the bottom edge of the step rather than the top edge. When constructing the wraparound step cover, in addition to the cover provided with various fastening strips and other sections and parts, two fasteners are required to be applied to the step, preferably a complementary mating hook-and-loop fastening strip along the front edge and on the top edge (towards back of step). The fastening strip shall be applied to the step in such a manner as to engage with the cover.

Figure 7:
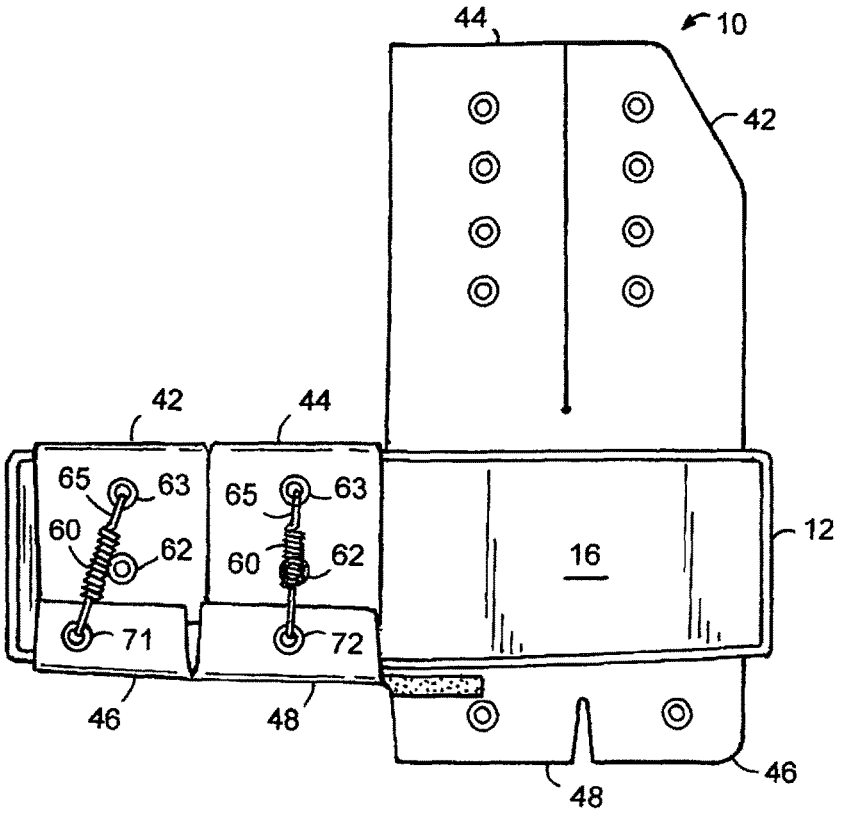
FIG. 7 illustrates a bottom view of an embodiment of a wraparound cover with bottom of step applied and partially secured thereon.

As can be further shown in FIG. 7, as cover 10 is applied to a step 12, the step is shown with bottom 16 exposed. Each of forward tabs 46 and 48 will be drawn against front of step and across back of step. Similarly, interior end 44 and outer end 42 of the rear will be drawn and tucked under forward tabs 46 and 48. Forward grommets 71 and 72 are thereby exposed to the underside of the step (as is all step sizes) and a fastener 60 is applied via hooks 65 to the most appropriate available grommet 61 through 64 (here shown attached to grommet 63). It is preferred that the spring is providing between two and fifteen pounds of pressure so that it is easily used by a hand to attach the spring to both grommets. The amount of force exerted to draw the forward and rear ends of the cover together along the multiple attachment points (here two attached and two remaining to be attached) will prevent ripples, puckering, or otherwise bunching of rug.

Figure 8:
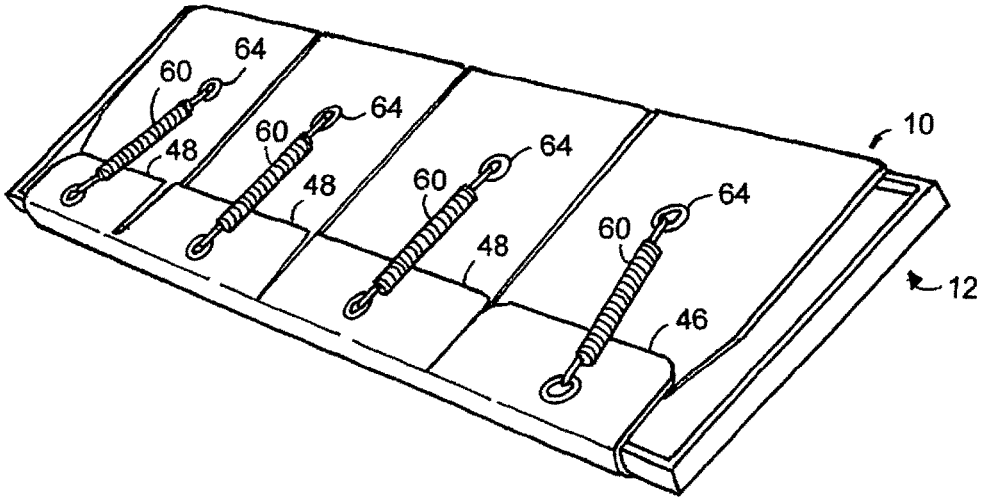
FIG. 8 illustrates a bottom perspective view of an embodiment of a wraparound cover applied to a small flat-flat step of the present invention.
Figure 9:
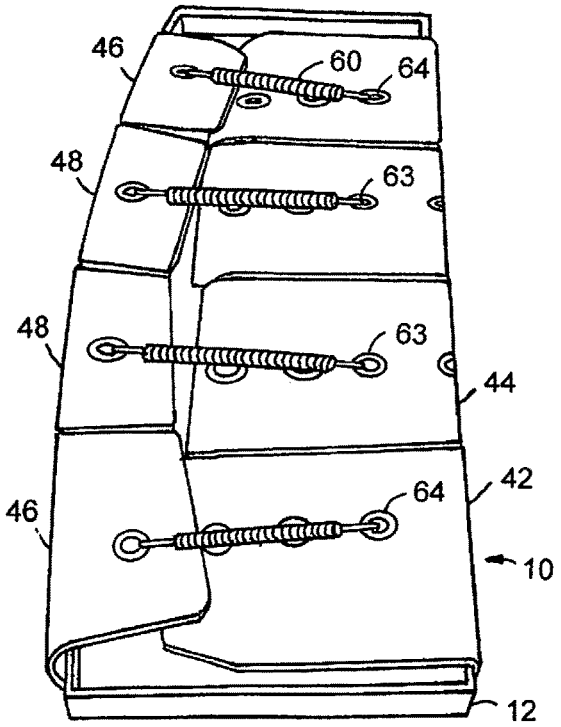
FIG. 9 illustrates a bottom perspective view of an embodiment of a wraparound cover applied to a small curve-flat step of the present invention.
Figure 10:
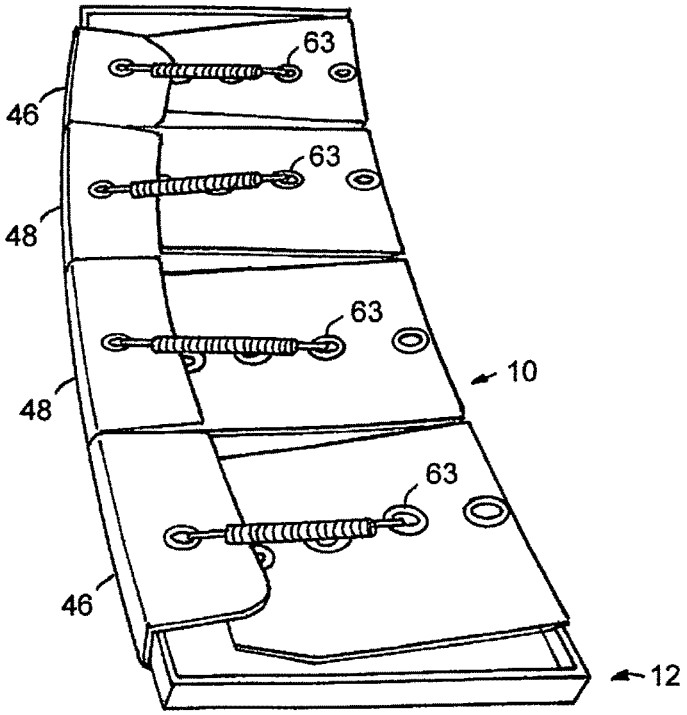
FIG. 10 illustrates a bottom perspective view of an embodiment of a wraparound cover applied to a small curve-curve step of the present invention.
Figure 11:
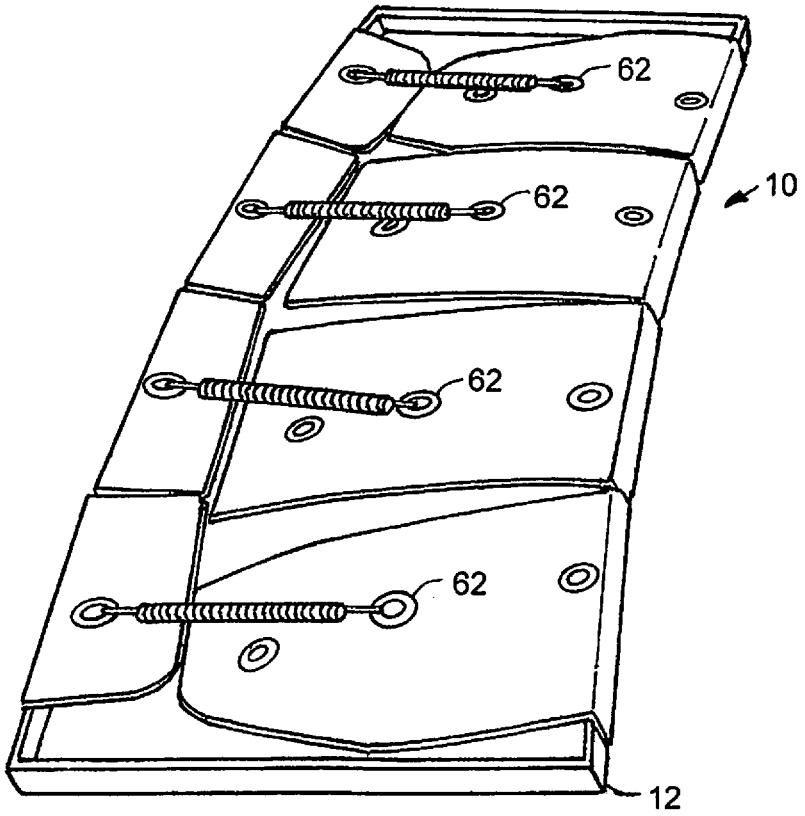
FIG. 11 illustrates a bottom perspective view of an embodiment of a wraparound cover applied to a large curve-curve step of the present invention.
Figure 12:
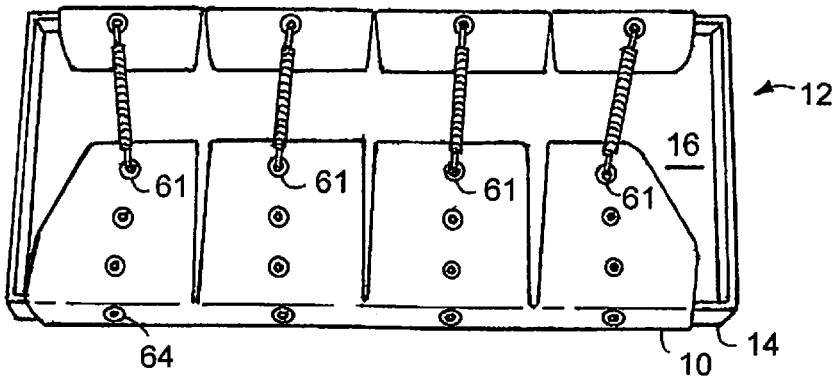
FIG. 12 illustrates a bottom view of an embodiment of a wraparound cover applied to a large flat-flat step of the present invention.

Referring now to FIGS. 8 through 12, the underside of the various size steps are shown. In each of these embodiments, the cover 10 is applied to step. Forward tabs 46 and 48 are folded over front of step while rear tabs are folded over back of step. When tabs are folded in such a manner as there is excess rear tab, it is preferable that the rear tab fold under, and possibly include an excess fold under forward tab to allow rear tab to fit in smaller steps. FIG. 8 demonstrates the short flat-flat step with a flat front and a flat back as is known in the art. The depth from front to back of such a step is approximately 8 inches, and the step is approximately ⅞ths inches tall. The ⅞ths inch tall front defines the width of forward fastening strip 67 (not shown). In such an embodiment, the nearest grommet 64 will be used to apply to a smaller step size. FIG. 9 represents the curve front flat back embodiment of a step. In such a case, inner tabs 48 will apply to rear inner tabs 44 along middle rear close grommet 63, while outer tabs 46 will apply to rear outer tabs 42 along rear interior grommet 64. In such steps, as is known in the art, the front to back distance of the step along the ends is approximately 8 inches while in the center it grows to 9 inches. Referring to FIG. 10 of the curve step with curve front and curve rear, the depth of the step is a constant 8 inches. Therefore, the middle rear close grommet 63 is used in all tabs. Viewing FIG. 11, a deeper step is shown with a curve front and curve rear. While maintaining a height of approximately ⅞ths inch, the depth of the step is approximately 10 inches from side to side. Finally, FIG. 12 demonstrates a large flat-flat step with approximately 10¾ inch depth and a height of 1¾ inches. This is the embodiment similar to that shown in FIG. 6. Each of the rear grommets 61 will be engaged with the fasteners. When the step is so large, it is considered that the rear interior grommet 64 will not be exposed along the bottom of step 12 but rather along the back end 14. It is preferred that in all embodiments, none of the rear grommets is exposed on the top side of the step.

Figure 13:
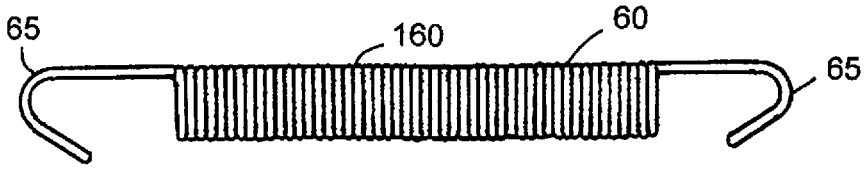
FIG. 13 illustrates a side view of a spring fastener of the present invention.

Referring to FIG. 13, fastener 60 is shown as a dual hooked spring. Fastener 60 includes hooks 65 on either end, hooks 65 adapted to engage through and hold onto grommets to draw ends of rug together. It is preferred that the spring includes anywhere between 50 and 70 rotations 160 preferably approximately 58 rotations give or take one or two. This provides for a tensile strength of approximately 5 to 10 pounds to draw spring between grommets.

Figure 15:
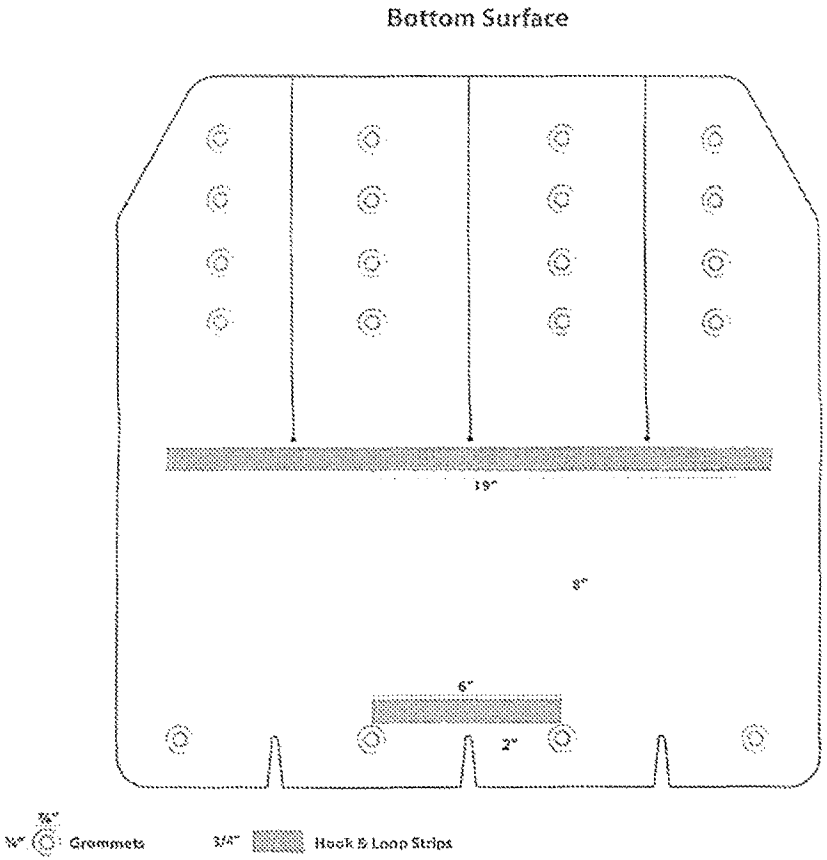
FIG. 15 illustrates a schematic bottom view of an embodiment of a wraparound cover of the present invention.
Figure 14:
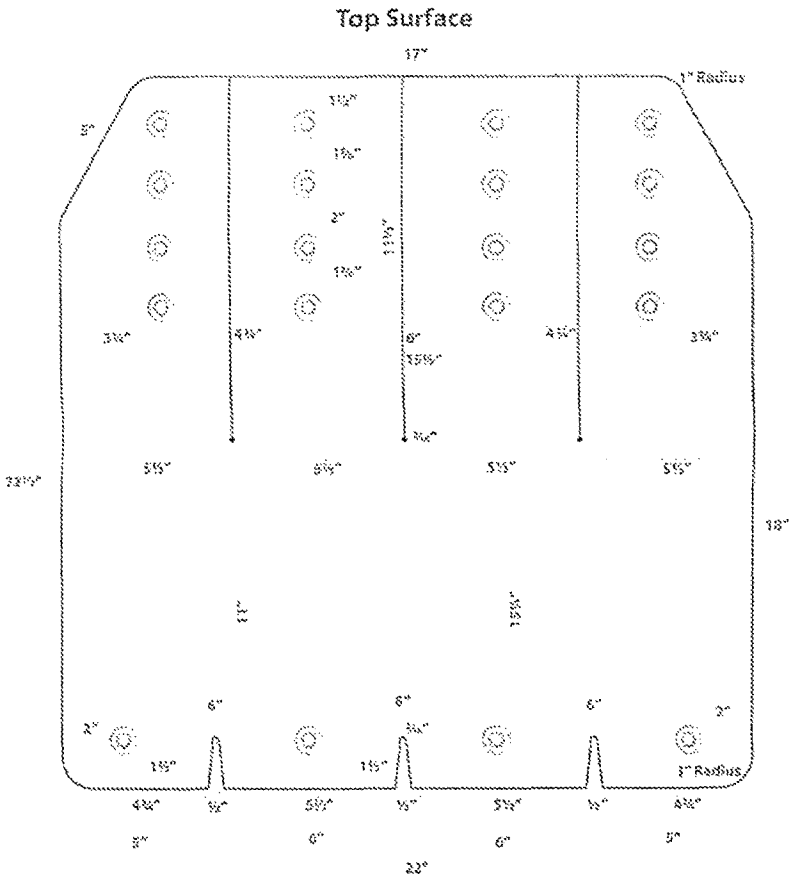
FIG. 14 illustrates a schematic top view of an embodiment of a wraparound cover of the present invention.

FIGS. 14 and 15 are included to demonstrate the dimensions of various aspects and features along the front and back of the wraparound cover.

I claim:

1. A wraparound cover for attachment to a step, said wraparound cover comprising:

(a) a cover extending across the step and having a top side and a bottom side, and an opposed front end and rear end foldable to the underside of the step;

(b) said forward end comprising at least three forward tabs, each of said forward tabs comprising a single forward attachment point;

(c) said rear end comprising at least three rear tabs opposite said forward tabs, each of said rear tabs comprising at least two rear attachment points;

(d) said bottom side comprising a first rear fastening strip and a second forward fastening strip, said first and second fastening strips positioned between said forward and rear tabs;

(e) at least three fasteners adapted to penetrating each of said forward attachment points and at least one of said rear attachment point to draw said first and second ends toward one another to secure said wraparound cover about the step.

2. The wraparound cover as set forth in claim 1 wherein each of said forward attachment points and said rear attachment points comprise a reinforced grommet hole.

3. The wraparound cover as set forth in claim 1 wherein said at least three fasteners comprise a spring with dual hooks on opposing ends.

4. A wraparound cover as set forth in claim 2 wherein said forward end comprises angled flaring gaps between each of said forward tabs, said angled flaring gaps comprising a base, said base aligned within ¼" of a center of said forward attachment point.

5. A wraparound cover as set forth in claim 1 wherein said first fastening strip and said second fastening strip are parallel one another.

6. A wraparound cover as set forth in claim 5 wherein said first fastening strip comprises a first rear edge and said second fastening strip comprises a second rear edge, said first and second rear edges spaced from one another by approximately eight inches.

7. A wraparound cover as set forth in claim 1 wherein said step comprises a first complimentary fastening strip on a top side, and a second complementary fastening strip on a front side adapted to fasten with said first and second fastening strips, respectively.

8. A method for covering a step, said method comprising the steps of:

(a) wrapping a rug across the top of the step and to the underside of the step to locate the forward and rear ends of the rug along the underside of the step;

(b) fastening a first fastening strip along a bottom of the rug with a first complimentary fastening strip along a top side of the step, (c) fastening a second fastening strip along a bottom of the rug with a second complimentary fastening strip along a front side of the step, (d) drawing a rear tab along a rear end of the rug toward a forward tab along a forward end of the rug; and (e) coupling the rear tab with the forward tab via an elongated fastener.

9. The method of claim 8 whereby said step of drawing is repeated with at least three separate and adjacent rear tabs along the rear end to mate with complimentary three forward tabs along the front end.

10. The method of claim 9 whereby said step of coupling includes drawing at least one coupler from a location near a side along at least one of the forward tabs to a location further from the side along at least one of the rear tabs.

11. The method of claim 9 whereby said step of drawing is repeated with at least four separate and adjacent rear tabs along the rear end to mate with complimentary four forward tabs along the front end.

12. The method of claim 8 whereby said step of fastening the second fastening strip includes the second complimentary fastening strip arranged along a lower end of the front side of the step.

* * * * *